US005127686A

United States Patent [19]

Gleason et al.

[11] Patent Number: 5,127,686

[45] Date of Patent: Jul. 7, 1992

[54] DOOR CLOSURE ASSEMBLY

[75] Inventors: Stephen J. Gleason, Charles City; Marvin L. Larsen, New Hampton, both of Iowa

[73] Assignee: Tri-Mark Corporation

[21] Appl. No.: 655,114

[22] Filed: Feb. 14, 1991

[51] Int. Cl.[5] ..... E05C 21/02

[52] U.S. Cl. ..... 292/216; 292/DIG. 31; 292/336.3; 70/208

[58] Field of Search ..... 292/216, DIG. 31, 336.3; 70/228

[56] References Cited

U.S. PATENT DOCUMENTS

| | | | |
|---|---|---|---|
| 3,698,215 | 10/1972 | Truhon | 292/DIG. 31 |
| 3,848,909 | 11/1974 | Foley | 292/216 |
| 3,858,919 | 1/1975 | Kleefeld et al. | 292/216 |
| 3,934,435 | 1/1976 | Gresham | 292/DIG. 31 |
| 4,707,006 | 11/1987 | Garg et al. | 292/DIG. 31 |
| 4,735,447 | 4/1988 | Kleefeldt | 292/216 |
| 4,778,207 | 10/1988 | Gergoe | 292/DIG. 31 |
| 4,813,722 | 3/1989 | Viscome et al. | 292/DIG. 31 |
| 4,838,590 | 6/1989 | Isomura | 292/DIG. 31 |
| 4,911,487 | 3/1990 | Rackoki | 292/DIG. 31 |

*Primary Examiner*—Eric K. Nicholson

[57] ABSTRACT

A door closure assembly is disclosed that has a latch assembly, a housing assembly and a interior panel assembly. The latch assembly is easily mounted to a door and can have a tab that cooperates with a boss on the housing assembly to facilitate alignment of the housing assembly with the latch assembly. The housing assembly is designed to minimize water entry into the door closure assembly, minimize the number of parts that operate on the latch assembly and help identify the key to be used to operate one of the two locks thereof. The inside panel assembly is designed to reduce the number of parts required to operate the latch assembly and is designed so that the handle assembly extending therefrom can be partially rotated before operating the latch assembly.

15 Claims, 6 Drawing Sheets

Fig. 1
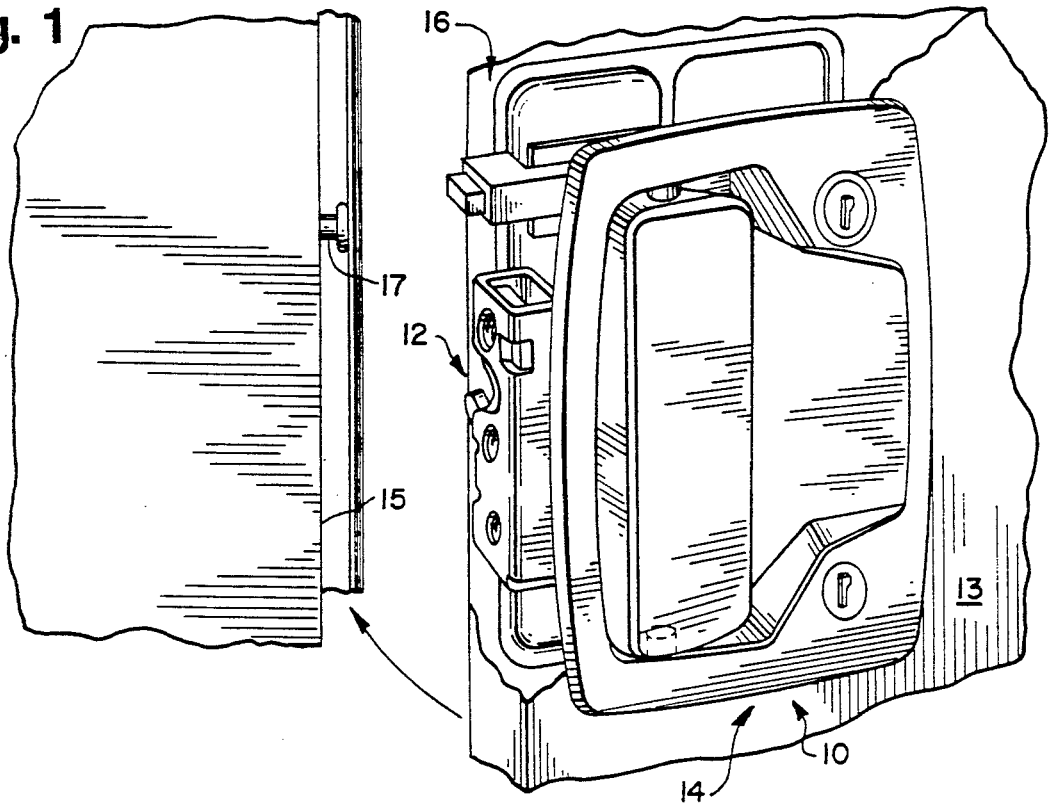
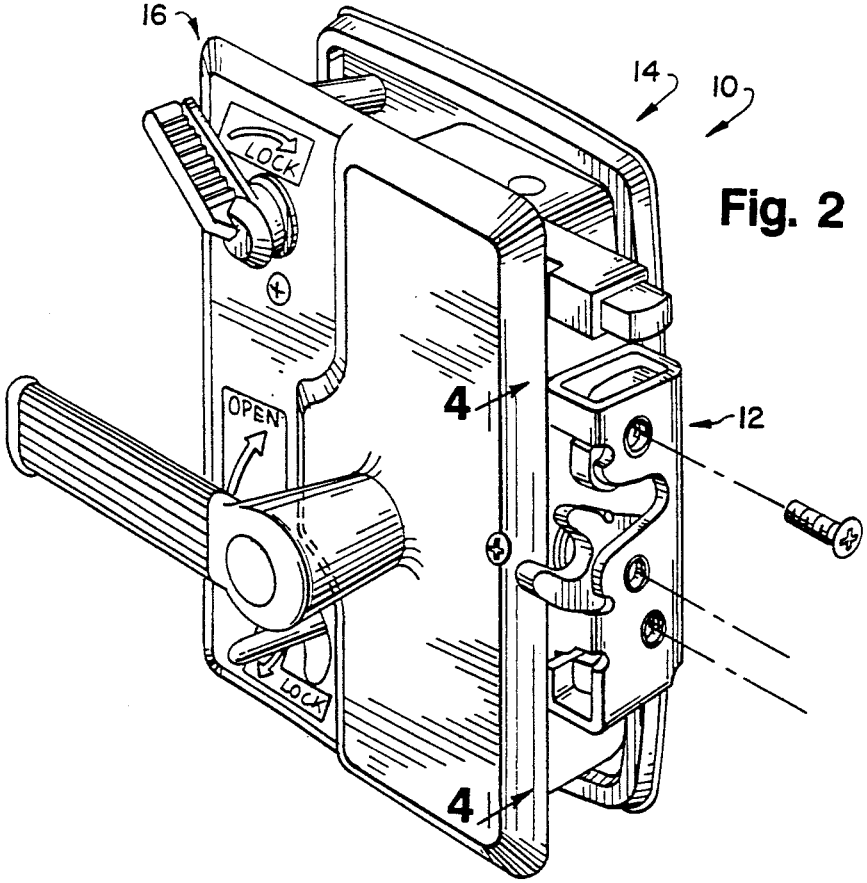
Fig. 2

Fig. 7
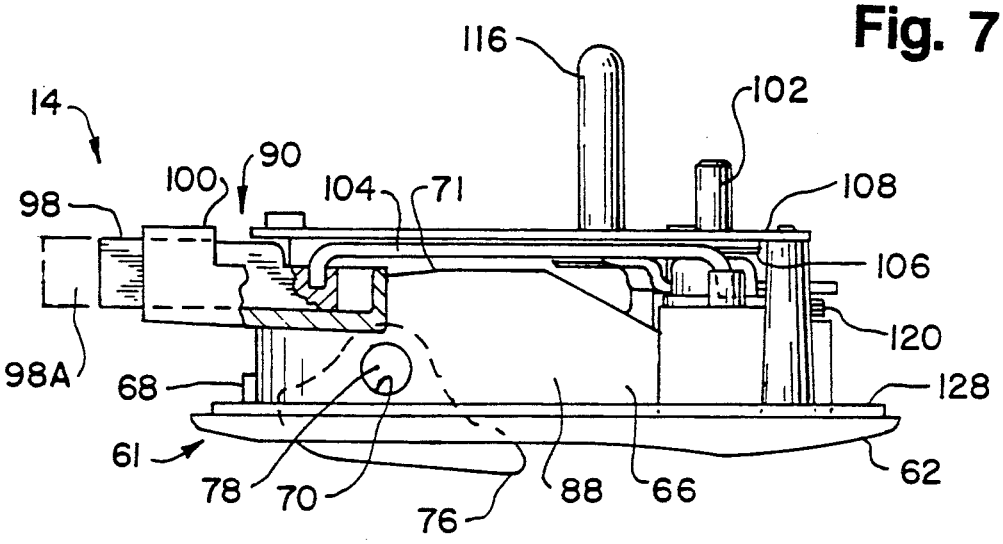
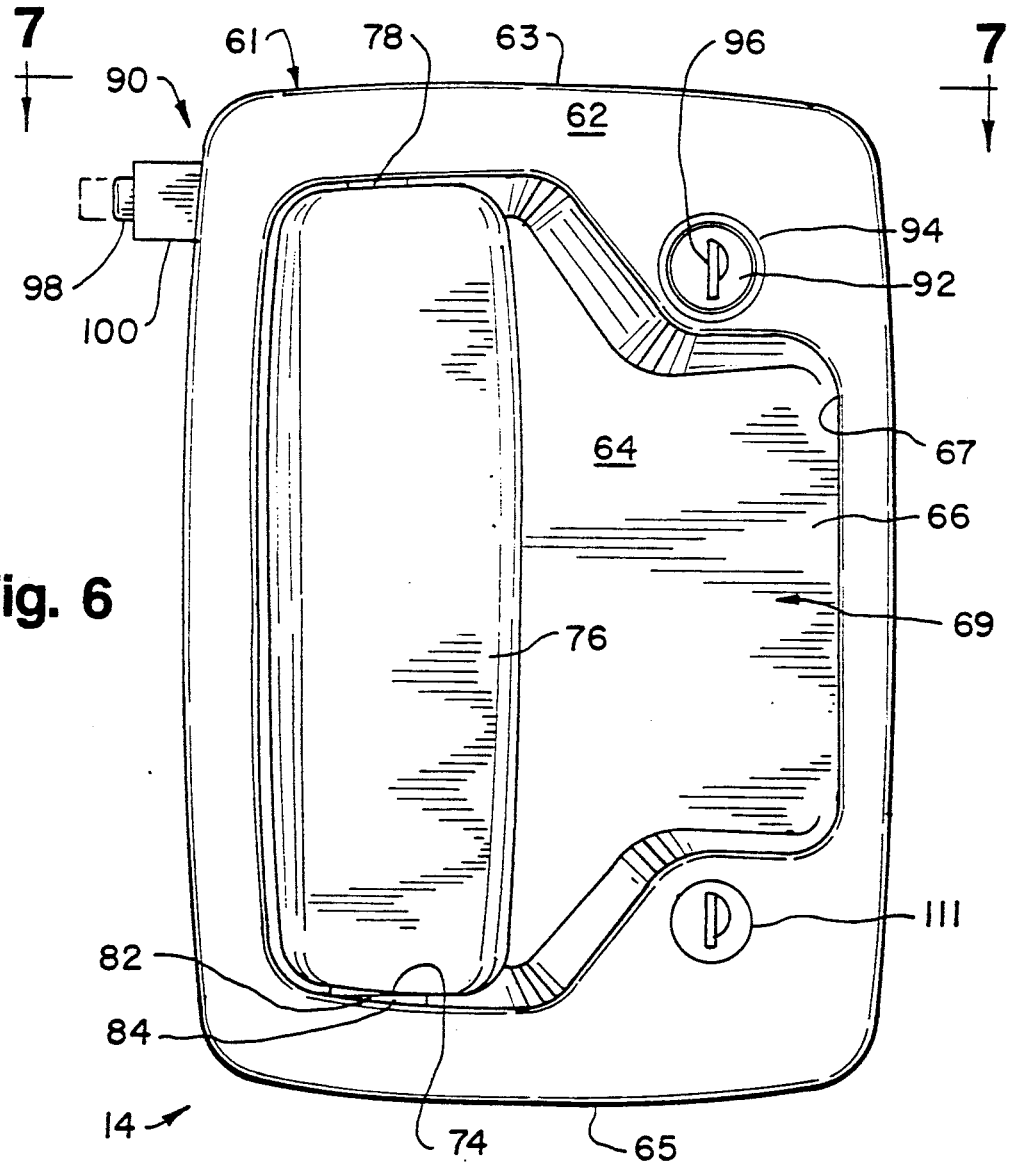
Fig. 6

DOOR CLOSURE ASSEMBLY

TECHNICAL FIELD

The present invention relates to door closure assemblies utilized to secure a door in a closed position, and in particular, to a door closure assembly that is easily installed, uses direct actuation of the latch assembly, permits use of the handle to close the door without acting upon the latch assembly and has a rotor assembly that has affixed thereto a trip lever assembly.

BACKGROUND OF THE INVENTION

Mechanisms to maintain doors in a closed position and permit the doors to be opened when desired are known. The doors of mobile homes, recreational vehicles and the like require the mechanisms to have an outside handle and an inside handle that both operate on a rotor of a rotor mechanism. The rotor engages a striker bolt affixed to the door frame to mold the door closed. The outside handle preferably is flush with the door to provide an aerodynamic configuration and to minimize the likelihood of the outside handle catching on objects that may come in contact with the outside of the door. Typically, the mechanism has a body that defines a recess in which the outside handle is positioned. Often, a number of parts are required to secure the outside handle to the body thus increasing the cost and the complexity in assembling the mechanism. Also, the way in which the outside handle is connected to the body can result in a opening in the body through which water can enter the mechanism and cause damage thereto.

The handles are indirectly mechanically linked to the rotor to rotate the rotor to disengage the striker bolt and permit the door to be opened. Unfortunately, the indirect mechanical linkage is often complicated which increases the costs, the time required to assemble the mechanism and the likelihood that the mechanical linkage will fail.

Also, care must be taken to ensure that the exterior handle mechanical linkage is operably associated with the rotor mechanism Many mechanisms do not provide a satisfactory way to achieve the alignment for operable association other than by sight and/or trial and error which are often unsatisfactory as they can waste time.

One way in which the mechanism and door are assembled is to provide an opening in the door. The rotor mechanism is then affixed to the edge of the door. Unfortunately, the rotor mechanism is often difficult to install because bolts inserted through the door edge and holes in the rotor mechanism must be secure using lock washers and nuts. The use of lock washers and nuts requires extra parts and further complicates assembly of the door and mechanism as these extra parts must be aligned with the bolt and fastened thereon.

Many rotor mechanisms do not have an easily usable actuator to rotate the rotor into a disengaged position when installing the mechanism. Thus, if the rotor engages the striker bolt, an expedient, e.g. a screwdriver, must be utilized to disengage the rotor. The use of an expedient can harm the rotor mechanism and can harm the person assembling the mechanism to the door.

Additionally, the interior handle mechanical linkage can be very responsive to the movement of the interior handle. Thus, if the interior handle is utilized to push or pull the door closed, the mechanical linkage can hold the rotor in the disengaged position thus preventing the door from being held closed by the rotor.

A door closure assembly that solves some of the problems in the aforementioned mechanisms would be highly desirable.

SUMMARY OF THE INVENTION

The present invention is directed to a door closure assembly that can have a housing assembly, a latch assembly and an inside panel assembly. The door closure assembly is mounted in a door having an opening therethrough by first mounting the latch assembly. The housing through by first mounting the latch assembly. The hosing assembly and inside panel assembly then are placed over the opening in the door in proper alignment and fastened together. The doorframe has a striker bolt that cooperates with the latch assembly to keep the door shut.

The housing assembly has a housing that can be rectangularly shaped. The housing has an exterior surface, an interior surface and terminates at an inner edge that forms a perimeter of a centrally located opening in the housing. The connected side walls of the housing assembly turn interiorly from the edge at an angle and end at a bottom panel. The side walls and bottom panel define a recess of the housing assembly. The side walls have interior side wall surfaces. An opening extends through one of the side walls. A paddle fits within the recess and is pivotally associated with the housing. The side walls have interior side wall surfaces. An opening extends through one of the side walls. A paddle fits within the recess and is pivotally associated with the housing. The paddle can have an integrally manufactured shank for providing pivotal association. The shank is received in the side wall opening.

The side wall opposed to the side wall having the opening can have opening with the surface of the side wall adjacent to the opposed side wall opening being substantially flat. The paddle can define an opening therein and have a substantially flat surface adjacent to the opening. An axle extends through the opposed side wall opening and the paddle opening to pivotally associated the paddle with the housing. The two substantially flat surfaces are adjacent to each other.

A pivot arm is located adjacent to the interior side wall surface and is operably connected to the axle. Pivoting of the paddle results in the pivot arm also being pivoted due to the axle.

The housing assembly can also have a dead bolt assembly to provide a method of locking the door closed. The dead bolt assembly can have a dead bolt actuator pin that is operably associated with a dead bolt key plug that extends through the housing to permit the dead bolt to be operated from the exterior of the door. The dead bolt key plug can be in a raised boss that extends from the exterior housing surface.

The housing assembly can also have a lock assembly that includes a lock assembly actuator pin extending from the interior housing surface and through a lock plate secured thereto The lock assembly actuator pin is operably associated with a lock assembly key plug that is on the exterior housing surface. Preferably, the lock assembly key plug is not on a raised boss. Rotation of the lock assembly actuator pin causes the lock plate to rotate and prohibit the latch assembly from being disengaged and thereby prevent the opening of the door. The lock assembly can have a lock arm that can be utilized to rotate the lock plate from a remote position.

The interior side wall surface can have an alignment boss extending therefrom that assists in aligning the latch assembly and the housing assembly.

The latch assembly has a rotor assembly and a trip lever.

The rotor assembly has an exterior plate and an interior plate. Extending substantially perpendicularly from the interior plate towards the interior of the door closure assembly are a sill and an alignment tab. The sill receives the trip lever thereon in a pivotal manner. The tab cooperates with the alignment boss to facilitate the aligning of the latch assembly and the housing assembly.

In a space defined between the exterior plate and the interior plate are a strike, a rotor, and a catch. The rotor has opposed fingers that form a U-shaped notch and a rotor shoulder The U-shaped notch can receive the striker bolt which is engaged by the opposed fingers upon the rotation of the rotor. The catch has a first arm and a second arm. The rotor shoulder and the first arm are engaged.

Through each of the inside plate, strike, rotor, catch and outside plate are apertures through which axles are placed and secured. The apertures of the strike, rotor and catch are not aligned. The axles have holes therethrough that can be threaded to receive a threaded bolt that extends through the door edge to which the rotor assembly is mounted. The use of the threaded holes makes the mounting of the rotor assembly to the door edge easier because a worker need only align the holes and then screw in the bolts as opposed to placing a bolt slidably through the hole and then affixing a lock washer and nut to the end of the bolt.

The trip lever is secured to the sill of the rotor assembly. The trip lever has a tang, projection and finger all extending therefrom The tang engages the second arm of the catch to rotate the rotor into a disengaged position from the engaged position. The finger is operated on by the pivot arm to pivot the trip lever plate, and hence the tang, to move the rotor into a disengaged position. The projection extends substantially perpendicular from the trip lever and towards the inside panel assembly. The projection is associated with the inside panel assembly which can operate thereon to move the rotor into a disengaged position.

The inside panel assembly has a panel with an exterior surface and an interior surface. A handle assembly extends from the exterior surface through the panel and is fastened to a release arm. The release arm has a window that receives the projection of the trip lever. The window is sized and positioned so that the handle assembly must be partially rotated before the release arm will engage the protrusion to move the trip lever. Therefore, the partial rotation of the handle assembly that occurs during closure of the door using the handle assembly will not cause movement of the protrusion to maintain the rotor in a disengaged position. Thus, the handle assembly can be utilized to close the door and the rotor will engage the striker bolt to latch the door shut.

The integrally cast shank of the paddle eliminates the need for a second axle to pivotally associate the paddle with the housing. The assembly of the axle and pivot arm provides direct actuation of the trip lever upon outward pivoting of the paddle. The direct fastening of the inside release arm to the handle assembly provides direct actuation of the trip lever. Direct actuation is preferable to indirect actuation which requires the use of additional moving parts that would increase the cost and complexity of the door closure assembly and which could more readily break down.

The adjacent substantially flat surfaces adjacent to the opposed side wall opening and the paddle opening are positioned with the flat side wall surface beneath the flat paddle surface. The configuration of these two surfaces minimizes the likelihood of water entering into the door closure assembly through the opposed side wall opening.

The attachment of the trip lever to the rotor assembly permits the trip lever to be utilized to rotate the rotor into a disengaged position before the housing assembly or inside panel assembly are installed. Thus, the rotor can be rotated into a disengaged position using the trip lever rather than resorting to an expedient that can damage the rotor assembly or harm the assembler.

The present door closure assembly can be utilized on doors of varying thicknesses. When the door thickness is great, minor changes in the door closure assembly will permit its use in such a door. The minor changes include utilizing a trip lever having a step that moves the finger and protrusion towards the housing assembly. Alternatively, the release arm can be modified to include a step to position the window about the protrusion and the pivot arm can be elongated. Any combination of modifications that maintain the operability of the door closure assembly can be utilized.

The inside panel preferably has an external surface that is textured and lettering and arrows to indicate the operation of the dead bolt assembly, handle assembly and the lock assembly in flat, untextured sections of the surface. The handle assembly can include a grip that is ribbed, preferably by a ribbed rubber sleeve thereover, and a stem that is not textured. The shape and design of the exterior panel surface and the handle assembly are aesthetically pleasing. The curved edges of the housing and paddle and the use of a boss to raise one of the key plugs makes the exterior surface of the housing assembly aesthetically pleasing.

Numerous other advantages and features of the present invention will become readily apparent from the following detailed description of the invention, the figures and the appended claims.

BRIEF DESCRIPTION OF THE DRAWINGS

FIG. 1 is a front partial, perspective view of a door including the door closure assembly;

FIG. 2 is an elevational view of the door closure assembly taken from the inside panel assembly;

FIG. 6 is an elevational view of the housing assembly as viewed from the exterior of the door;

FIG. 7 is a top planar view of the housing assembly taken along line 7—7 of FIG. 6;

DETAILED DESCRIPTION OF THE PREFERRED EMBODIMENTS

Figure 3:
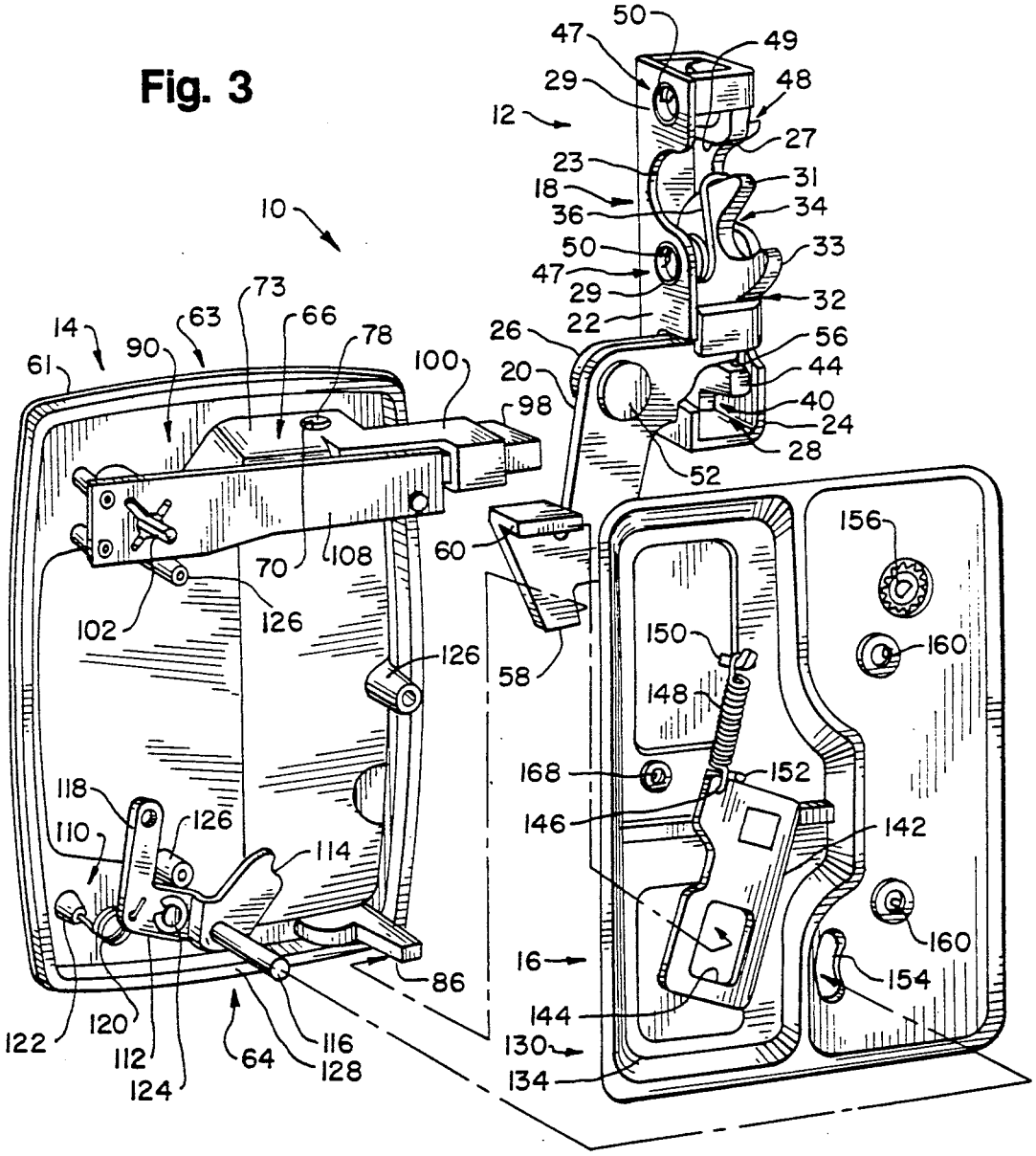
FIG. 3 is an exploded view of the door closure assembly with the inside panel assembly rotated 180 to reveal the interior thereof.

Although this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

As shown in FIGS. 1 and 2, a door closure assembly 10 has a latch assembly 12, a housing assembly 14 and an inside panel assembly 16. The door closure assembly 10 is mounted into an opening of a door 13 by mounting the latch assembly 12 to an edge (not shown) of the door 13 using threaded bolts and then placing the housing assembly 14 partially in the opening from the outside of the door 13 and the inside panel assembly partially in the opening from the inside of the door 13 and securing the housing assembly 14 and inside panel assembly 16 together to sandwich a part of the door 13 therebetween. The door frame 15 has a striker bolt 17 which cooperates with the latch assembly 12 to maintain the door 13 in a closed position.

FIG. 3 shows an exploded view of the door closure assembly 10 and the relationship of the latch assembly 12, housing assembly 14 and inside panel assembly 16.

Figure 5:
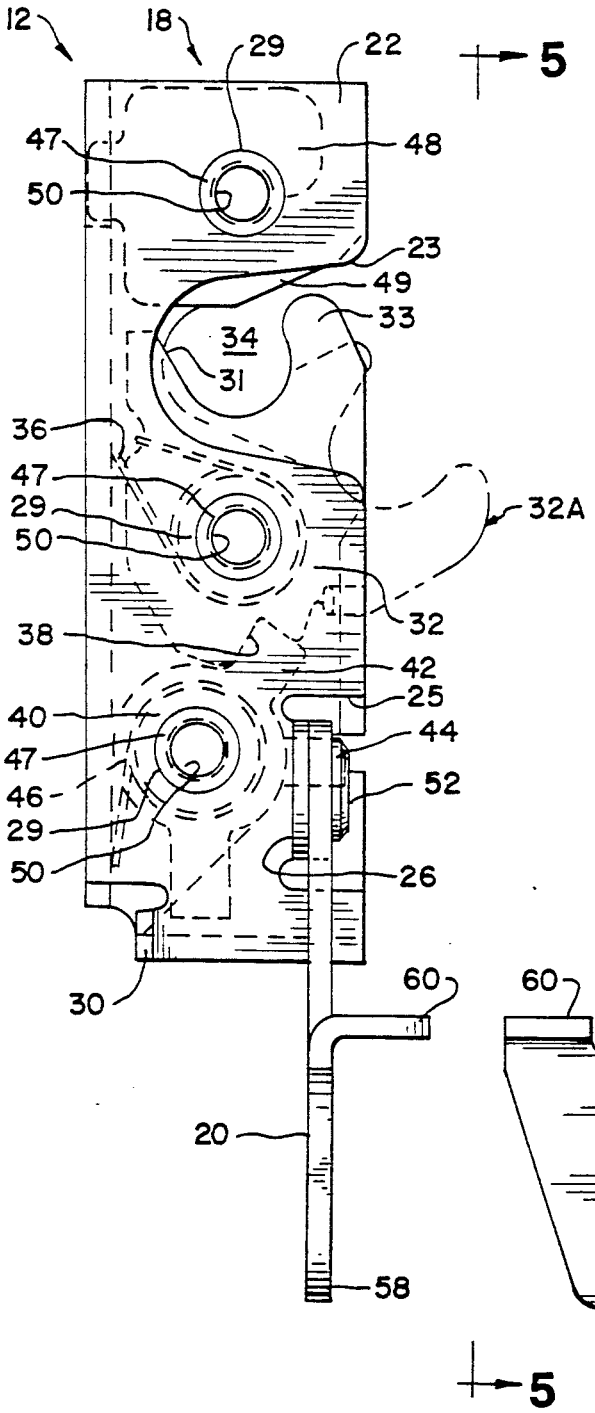
FIG. 5 is a side elevational view of the latch assembly taken along line 5—5 of FIG. 4.
Figure 4:
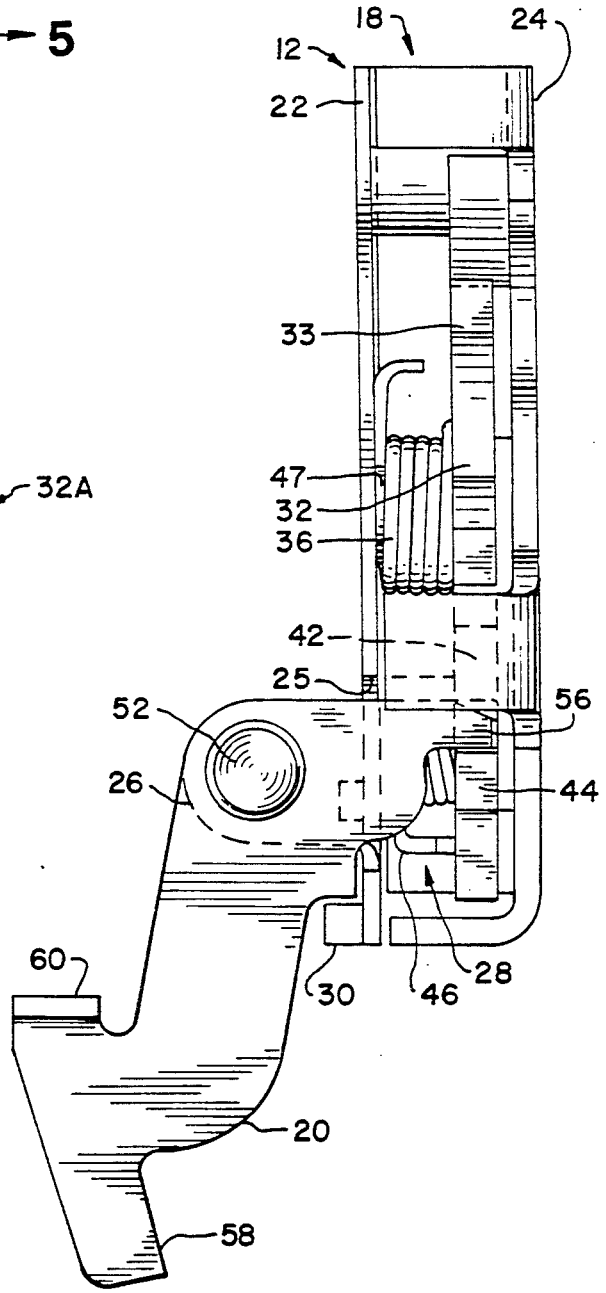
FIG. 4 is an elevational view of the latch assembly taken along line 4—4 of FIG. 2.

As shown in FIGS. 4 and 5, the latch assembly 12 has a rotor assembly 18 and a trip lever 20. The rotor assembly has an inside plate 22 and an outside plate 24 and has therebetween a rotor 32, a catch 40 and a strike 48. The inside plate 22 has a substantially rectangular shape with a U-shaped cut out 23 and a substantially rectangular cut out 25 both in communication with the same edge of the inside plate 22. The outside plate 24 has a U-shaped cut out 27 that is aligned with the U-shaped cut out 23. The inside plate and outside plate 24 have three aligned apertures 29. A sill 26 extends substantially perpendicularly from the inside plate 22 away from the outside plate 24 and has the trip lever 20 pivotally affixed thereto. An alignment tab 30 extends from the inside plate 22 away from the outside plate 24 and is utilized to directly align the housing assembly 14 with the latch assembly 12 and to indirectly align the inside panel assembly 16 with the housing assembly 14 and the latch assembly 12.

The inside plate 22 and the outside plate 24 define a space 28 therebetween having an open, elongated side adjacent to the sill 26. The rotor 32 is a plate having opposed fingers 31 and 33 extending at one side of the rotor 32 defining a U-shaped notch 34 therebetween and a rotor shoulder 38 at an opposed side of the rotor 32. When the door is being closed, the striker bolt 17 contacts the rotor finger 31 to force the rotor 32 to rotate which causes the rotor finger 33 to be rotated to a position behind the striker bolt 17 and causes striker bolt 17 to be captured in the U-shaped notch 34. Thus, the rotor 32 reversibly engages the striker bolt 17 to hold the door closed. The solid lines show the rotor 32 in the engaged (closed) position and the dotted lines 32A show the rotor in the disengaged (open) position.

The space 28 also contains a catch 40 positioned below the rotor 32 of the mounted latch assembly 12. The catch 40 is a plate having a first arm 42 that, when the catch 40 is positioned in the latch assembly 12, extends towards the rotor 32 and a second arm 44 that extends towards the inside panel assembly 16 and is next to the rectangular shaped cut out 25 in the inside plate 22. The first arm 42 engages the rotor shoulder 38. When the rotor 32 is in the engaged position, the catch 40 maintains the rotor 32 in the engaged position. When the rotor 32 is in the engaged position, the second arm 44 is operably associated with the trip lever 20. Pivoting of the trip lever 20 urges the second arm 44, and the first arm 42, away from the rotor 32 to enable the rotor 32 to rotate into the disengaged position.

The space 28 also contains a strike 48 positioned above the rotor 32 of the mounted latch assembly 12. The strike 48 has a sloped edge 49 that, when the strike 48 is positioned in the latch assembly 12, extends between the U-shaped cut outs 23 and 27. The edge 49 cooperates with the rotor 32 to assist in engaging the striker bolt by guiding the striker bolt into position with respect to the rotor 32, i.e., by guiding the striker bolt into contact with the first finger 31.

A way to assemble the latch assembly 12 is to place the strike 48, rotor 32 and catch 40 in the space 28 with the rotor 32 between the strike 48 and catch 40. Apertures (not shown) in the strike 48, rotor 32 and catch 40 are aligned with the apertures 29 of inside plate 22 and outside plate 24. Axles 47 are inserted through the apertures in the rotor 32, catch 40 and strike 48 and the ends of the axles 47 are punched to create flanges that secured the latch assembly 12 together. The axles 47 have holes 50 therethrough that can be threaded.

A rotor spring 36 is positioned about the rotor 32 and the axle that goes through the rotor 32 to urge the rotor 32 into a disengaged position (as shown in FIG. 5 by broken lines 32A) and maintain the rotor 32 in the disengaged position until acted upon by the striker bolt.

A catch spring 46 is positioned about the axle 47 that goes through the catch 40 to urge the first arm 42 into contact with the rotor shoulder 38.

The trip lever 20 is pivotally connected to the sill 26 as by a rivet 52. The trip lever 20 is a plate that has a tang 56, a finger 58 and a projection 60 extending therefrom. The tang 56 is at an end of the trip lever 20 that is opposed to the end having the finger 58 and the projection 60 thereon. The opposed ends are on either side of the rivet 52. The tang 56 is operably associated with the second arm 44 when the U-shaped notch 34 is in the engaged position and operates upon the second arm 44 to obtain the above-described results. The finger 58 is adjacent to the projection 60. The projection 60 extends towards the inside panel assembly 16.

As shown in FIGS. 6 to 9, the housing assembly 14 has a housing 61 terminating in an inner edge 67 that forms a perimeter of a centrally located opening 69. Side walls 66 turn inwardly from the edge 67 and end at a bottom panel 71. The side walls 66 and bottom panel 71 define a recess 64. The housing has an exterior surface 62, an interior surface 73, a top 63 and a bottom 65. The side walls 66 have interior surfaces 88. Alignment boss or bosses 68 extend from the interior side wall surface 88 at a location thereon so that the tab 30 of the rotor assembly 18 can engage the alignment boss 68 to align the housing assembly 14 with the latch assembly 12.

As can be seen in FIG. 3, when the door closure assembly 10 is together, the pivot arm 86 is in contact with the finger 58. Pivoting of the paddle 76 causes the axle 84 to pivot which causes the pivot arm 86 to pivot. The pivot arm 86 causes disengagement of the engaged rotor 32 by moving the finger 58 and hence the entire trip lever 20 about the rivet 52 to urge the tang 56 downward, as shown in the FIG., to force the second arm 44 downward and permit the rotor 32 to disengage the striker bolt 17.

The side walls 66 have therethrough a top opening 70 adjacent to the top end 63 and a bottom opening 72 adjacent to the bottom end 65. Adjacent to the bottom side wall opening 72 is a bottom surface 74 exteriorly located within the recess 64 that is substantially flat.

A paddle 76 is received in the recess 64 and is pivotally associated with the housing assembly 14. Preferably, the paddle 76 is generally flush with the exterior surface 62 when the paddle 76 is not in use. The paddle 76 has a shank 78 integrally formed therewith that extends from an end and an opening 80 defined in an opposed end. A surface 82 adjacent to opening 80 is substantially flat.

The paddle 76 is inserted into the recess 64 by inserting the shank 78 into the top opening 70 and sliding the paddle 76 into position. The bottom side wall opening 72 and the paddle opening 80 are aligned which also aligns the surfaces of the bottom side wall surface 74 and the paddle surface 82 The shape and alignment of the two surfaces 74 and 82 help to minimize water seepage through the bottom wall opening 72 into the door closure assembly 10. Gravity forces surfaces 74 and 82 into contact to form a seal that resists water penetration therebetween and thereby inhibit the penetration of water into the openings 72 and 80.

An axle 84 is placed through the paddle opening 80 and the bottom side wall opening 72 to couple the paddle 76 and the housing assembly 14 together. A pivot arm 86 is positioned interiorly adjacent to the interior side wall surface 88 and affixed to the end of the axle 84 so that pivoting of the paddle 76 causes pivoting of the pivot arm 86. The pivot arm 86 is operably associated with the finger 58 of the trip lever 20 so that when the handle 76 is pivoted, the pivot arm 86 engages the finger 58 to cause the tang 56 to act upon the second arm 44 if the rotor 34 is in the engaged position.

The housing assembly has secured thereto a dead bolt assembly 90 which has on the exterior housing surface 62 a dead bolt key plug 92 on a raised boss 94 and a key hole cover plate 96.

The dead bolt assembly 90 also has a dead bolt 98, dead bolt housing 100, dead bolt actuator pin 102, link bar 104, detent spring 106 and cover 108. The dead bolt 98 is reciprocally associated within the dead bolt housing 100. FIGS. 6 to 9 show, in broken lines 98A, the extended dead bolt. When extended, the dead bolt 98 engages a recess (not shown) in the door frame. The dead bolt housing 100 guides the dead bolt 98 and protects it from tampering. The dead bolt actuator pin 102 is connected to the dead bolt key plug 92 so that rotation of the key within the dead bolt key plug 92 causes the dead bolt actuator pin 102 to rotate. The link bar 104 connects the dead bolt actuator pin 102 with the dead bolt 98 so that rotation of the dead bolt actuator pin 102 causes the dead bolt 98 to extend and retract. The detent spring 106 keeps the dead bolt 98 and link bar 104 off center so that the dead bolt 98 cannot be forced into the retracted position without using the dead bolt actuator pin 102. The detent spring 106 also gives the user a "feel" for when the dead bolt 98 is in the extended or retracted position when using the dead bolt actuator pin 102. The cover 108 has the dead bolt actuator pin 102 extending therethrough and goes over the link bar 104 and part of the dead bolt housing 100 to protect the link bar 104 and the part of the dead bolt housing 100 from interference from foreign objects.

The housing assembly 14 also has secured thereto a lock assembly 110 which has on the exterior housing surface 62 a lock assembly plug 111 that is preferably flush with the exterior housing surface 62.

Figure 8:
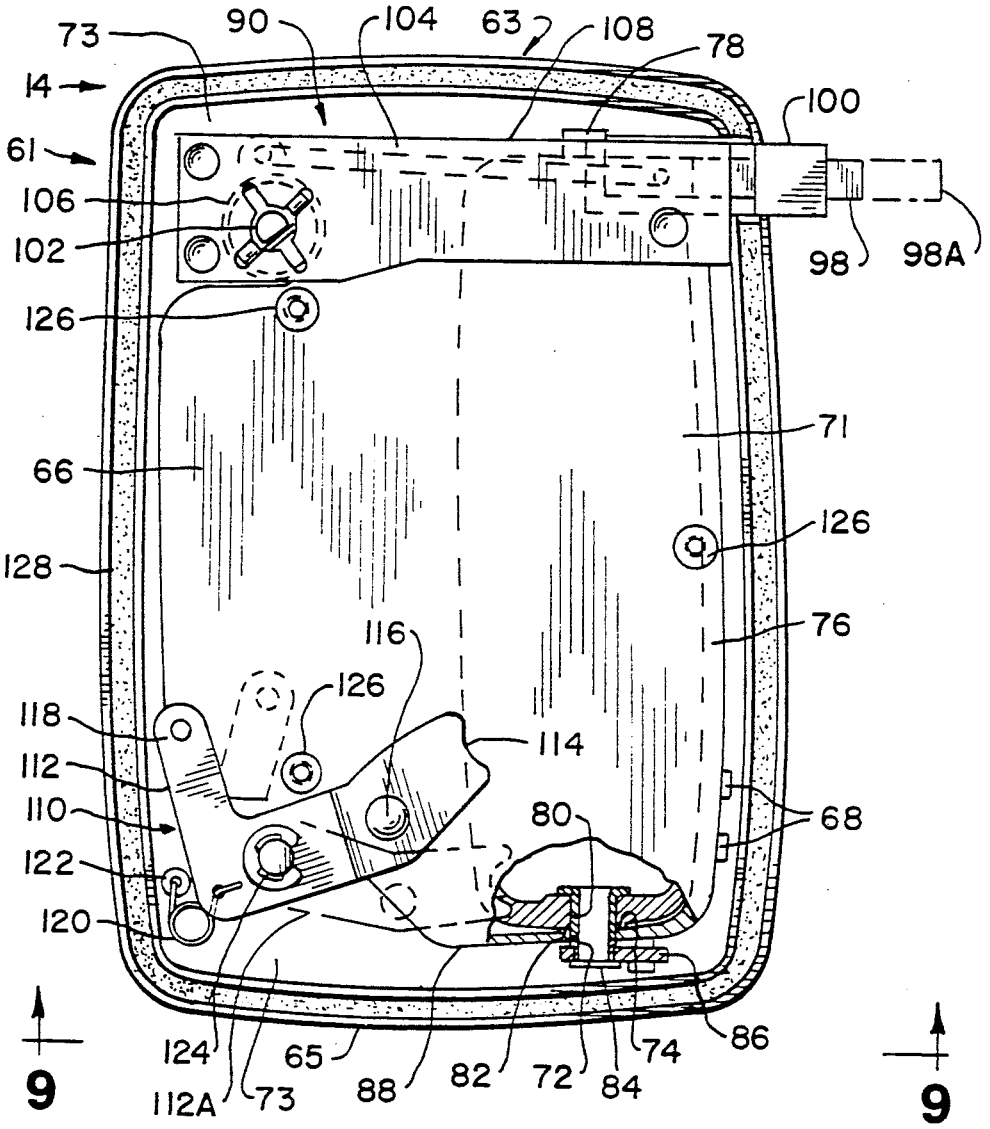
FIG. 8 is an elevational view of the interior of the housing assembly.
Figure 9:
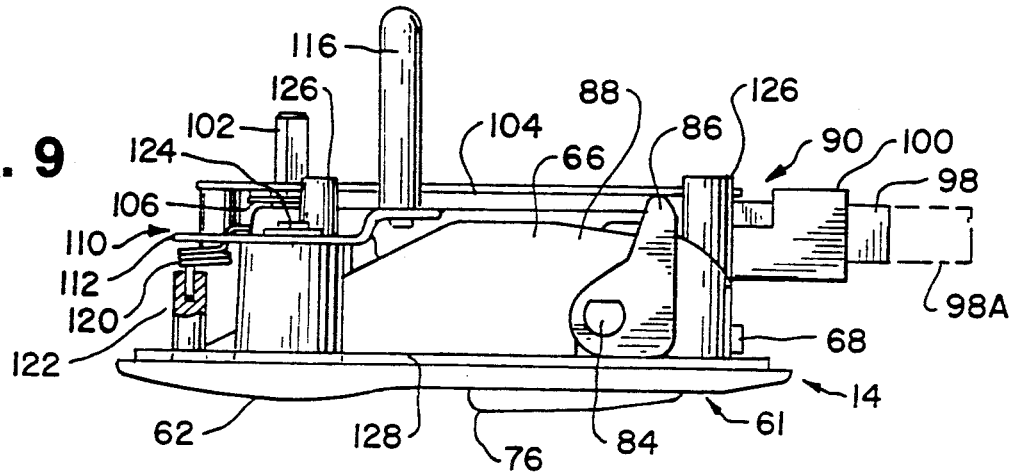
FIG. 9 is a bottom planar view of the housing assembly taken along line 9—9 of FIG. 8.

The lock assembly 110 also has an interiorly located lock plate 112 having a lock notch 114, a lock handle 116, and a lock arm 118, a lock spring 120, a lock spring mount 122 and a lock assembly actuator pin 124. The lock assembly actuator pin 124 is an extension of the lock assembly plug 111 wherein rotation of the lock assembly plug 111 causes the lock assembly actuator pin 124 to rotate. The lock plate 112 is a generally L-shaped plate that has the lock assembly actuation pin 124 extending therethrough in a leg of the "L" proximate to the paddle 76 near where the two legs of the "L" meet. The proximate leg terminates in the lock notch 114 and has the lock handle 116 extending therefrom The distal leg of the "L" forms the lock arm 118. The lock spring 120 is connected to the lock plate 112 near where the two legs of the "L" meet. The lock plate 112 is pivotally secured to the lock assembly actuator pin 124 so that the lock plate 112 can be pivoted by the lock handle 116 or a key inserted into the lock assembly key plug 111. The lock plate 112 can be positioned, as shown in FIG. 8 by the solid lines, to permit movement of the trip lever 20 and therefore permit the door to be opened. The lock plate can be rotated to a position, as shown in FIG. 8 by the broken lines 112A, into a position whereby the lock notch would engage the trip lever to prohibit movement thereof and thereby prohibit opening of the door using the door closure assembly. The lock spring 120 and the lock spring mount 122 cooperate to maintain the lock plate 112 in the disengaged position unless overcome by using the lock handle 116 or the lock assembly key plug 111. The lock arm 118 can be operably associated with an external control (not shown) that rotates the lock plate 112 between the engaged and disengaged positions and overcomes the lock spring 120.

Extending from the interior side wall surfaces 88 and the bottom panel 71 are assembling posts 126 that are utilized to secure the door closure assembly 10 together and to the door.

A gasket 128 extends around the circumference of the housing assembly 14 to provide a watertight seal against the door upon which the door closure assembly is mounted.

Figure 10:
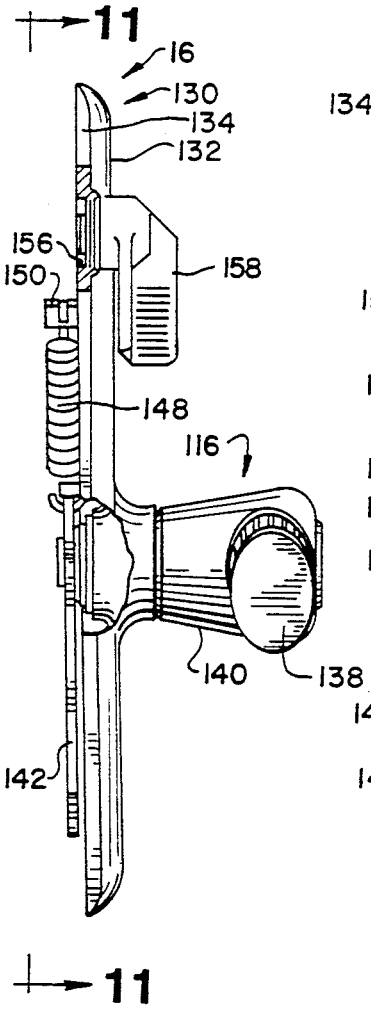
FIG. 10 is a side elevational view of the inside panel assembly.
Figure 11:
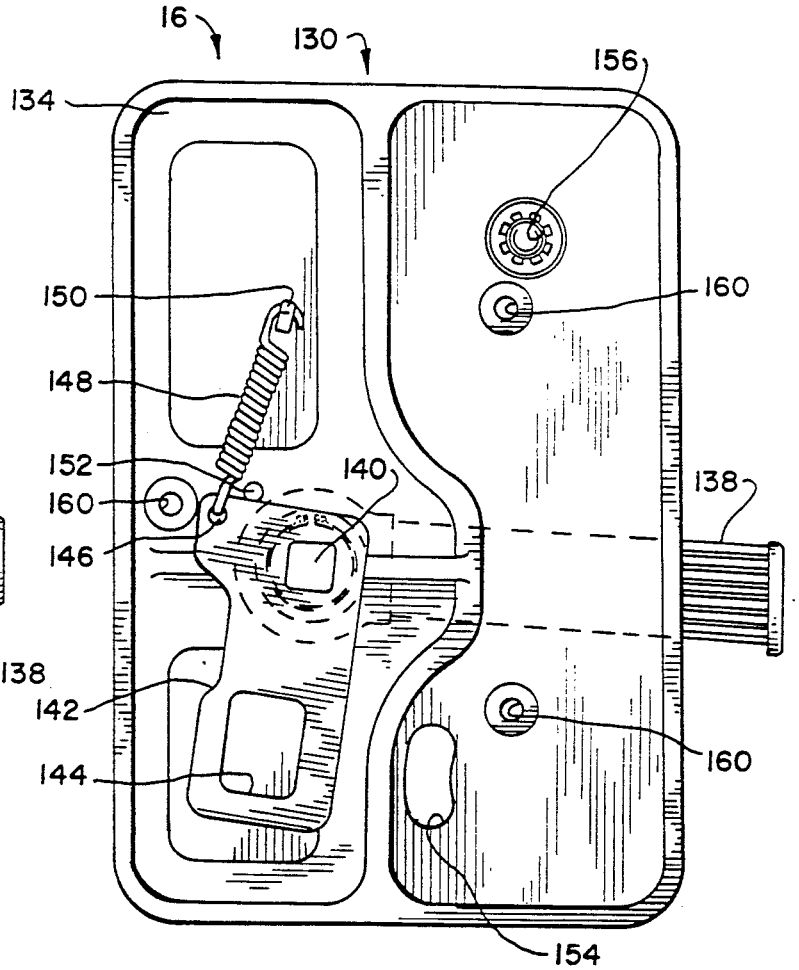
FIG. 11 is an elevational view of the interior of the inside panel assembly taken along line 11—11 of FIG. 10.

As shown in FIGS. 10 and 11, the inside panel assembly 16 has a panel 130 with an exterior panel surface 132 and an interior panel surface 134.

A handle assembly 136 extends from the exterior panel surface 132 and has a grip 138 and a stem 140. The grip 138 is preferably spaced from and coplanar with the panel 130. The stem 140 extends perpendicularly from and through the exterior panel surface 132 and is connected to the grip 138. Rotation of the grip 138 causes the stem 140 to rotate.

Interiorly located on the inside panel assembly 16 is a release arm 142 defining a window 144 at one end thereof. The release arm 142 is secured to the stem 140 at an end opposed from the end having the window 144. Rotation of the grip 138 causes the release arm 142 to rotate. The window 144 receives the projection 60 of the trip lever assembly 20 therein. The window 144 is larger than the projection 60 so that the grip 138 can be partially rotated without the inside release arm 142 engaging the projection 60. Once the grip 138 is rotated beyond the point of partial rotation and the inside release arm 142 engages the projection 60, the projection 60 is displaced causing pivoting of the trip lever plate 52 and causing the tang 56 to act upon the second arm 44 if the rotor is in the engaged position Preferably, the window 144 and the projection 66 are sized so that the grip 138 can be rotated about 5 to about 15 before the release arm 142 engages the projection 60.

To maintain the grip 138 in the desired orientation during shipment and installation, a hole 146 through the release arm 142 has one end of an extension spring 148 inserted therein and the opposed end of the extension spring 148 is secured to an attachment post 150 extending interiorly from the interior surface 134. A retention pin 152 extends interiorly from the interior surface 134. The extension spring 148 pulls the release arm 142 into contact with the retention pin 152 which is positioned so that when the release arm 142 is in contact therewith, the grip 138 is in the desired position After the door closure assembly 10 is installed, the release arm 142 contacts the protrusion 60 of the trip lever 20 to position the grip 138 in the desired orientation. The extension spring 148 is extended by rotation of the grip 138.

The panel 130 has therein an arc-shaped opening 154 that receives the lock handle 116 therein. The arced opening 154 permits the lock handle 116 to be moved to move the lock plate between locked and unlocked positions.

The panel 130 also has an opening 156 that is aligned with the dead bolt actuator pin 102 when the door closure assembly is put together. A dead bolt lock knob 158 is placed through the opening 156 and engages the end of the dead bolt actuator pin 102 and can rotate the same to extend and retract the dead bolt 98.

Assembling openings 160 align with the assembling posts 126 when the door closure assembly is put together. Screws (not shown) are inserted through the assembling openings 160 and are threaded into the assembling post 126.

The door closure assembly 10 is readily and easily installed, operates smoothly and can be utilized in doors having a wide range of thicknesses. Doors of even greater thicknesses can use the door closure assembly upon minor modification of the door closure assembly. For example, the trip lever assembly can be modified by having a step that moves the finger and projection away from the wall of the housing assembly so that the finger can still be engaged by the pivot arm and the projection can still be engaged by the inside release arm Alternatively, the pivot arm can be elongated or the release arm can have a step therein to move the window away from the panel. Alternatively, any combination of the modifications can be utilized to achieve the desired result.

The present door closure assembly directly operates upon the trip lever assembly by either the pivot arm which is directly operated on by the paddle or the release arm which is operated on by the handle assembly. This direct operation reduces costs of parts and increases reliability. The substantially flat surfaces of the paddle and the wall cooperate to inhibit water from entering the door closure assembly through the associated openings. The paddle has an integral shank as a cost and time saving measure. The recess can be deep to provide clearance for insertion of the fingers of an operator underneath the paddle. The window in the release arm permits the handle assembly to be partially rotated without maintaining the rotor in the disengaged position. The tab and boss cooperate for aligning the housing assembly to the latch assembly by feel rather than requiring visual confirmation of alignment or alignment by trial and error. The lock assembly has an arm for connection to an optional device for converting the lock assembly into a power lock assembly.

This invention has been described in terms of specific embodiments set forth in detail, but it should be understood that these are by way of illustration only and that the invention is not necessarily limited thereto. Modifications and variations will be apparent from this disclosure and can be resorted to without departing from the spirit of this invention, as those skilled in the art will readily understand. Accordingly, such variations and modifications of the disclosed invention are considered to be within the purview and scope of this invention and the following claims.

What is claimed is:

1. A door closure assembly suitable for use in maintaining a door in a closed position and permitting the door to be opened and including a latch assembly having a trip lever that acts upon a rotor capable of engaging a striker bolt to maintain the door in the closed position, the door closure assembly comprising:

a housing assembly having a housing that terminates at an inner edge that forms a perimeter of a centrally located opening in the housing, connected side walls turned inwardly from the edge, and a bottom panel at which the side walls terminate, the side walls and bottom panel defining a recess, the side walls having a first opening therethrough;

a paddle associated with the housing assembly within the recess, the paddle having a paddle opening extending therethrough, the paddle opening and the first side wall opening being aligned when the paddle is within the recess;

means for pivotally securing the paddle in the housing assembly extending through the paddle opening and the first side wall opening, the securing means pivoting when the paddle is pivoted; and a pivot arm affixed to the securing means, wherein pivoting of the paddle causes the pivot arm to directly move the trip lever if the rotor is in the engaged position.

2. A door closure assembly suitable for use in maintaining a door in a closed position and permitting the door to be opened and including a latch assembly having a trip lever that acts upon a rotor capable of engaging a striker bolt in an engaged position therefor to maintain the door in the closed position, said rotor being movable between the engaged position and a disengaged position, the door closure assembly comprising:

a trip lever that directly engages a rotor to rotate the rotor into the disengaged position;

a housing assembly having a housing that terminates at an inner edge that forms the perimeter of a centrally located opening in the housing, connected side walls turned inwardly from the inner edge, and a bottom panel at which the side walls terminate, the side walls and bottom panel defining a recess, the side walls having a first opening therethrough;

a paddle associated with the housing assembly within the recess, the paddle having a paddle opening extending therethrough, the paddle opening and the first side wall opening being aligned with the paddle within the recess;

means for pivotably securing the paddle in the housing assembly extending through the paddle opening and the first side wall opening, the securing means pivoting when the paddle is pivoted;

a pivot arm affixed to the securing means, wherein pivoting of the paddle causes the pivot arm to directly move the trip lever with the rotor in the engaged position; and an inside panel assembly comprising a panel having an exterior surface and an interior surface, a handle assembly extending from the exterior panel surface and through the panel, and a release arm operably associated with the handle assembly adjacent to the interior panel surface, the release arm having a window therein that receives the trip lever, wherein rotation of the handle assembly causes the release arm to move the trip lever with the rotor in the engaged position.

3. The door closure assembly in accordance with claim 2 wherein the window permits partial rotation of the handle assembly prior to moving the trip lever to permit the handle assembly to be utilized to close the door without maintaining the rotor in the disengaged position.

4. The door closure assembly in accordance with claim 1 wherein the side walls have a second opening therethrough opposed to the first side wall opening and the paddle has an integrally manufactured shank opposed to the paddle opening wherein the shank is received in the second side wall opening to pivotably associated the paddle with the housing assembly.

5. The door closure assembly in accordance with claim 4 wherein a surface adjacent to the first side wall opening and a surface adjacent to the paddle opening are flat and wherein the flat surfaces are adjacent to minimize water transport through the first side wall opening and the paddle opening.

6. The door closure assembly in accordance with claim 1 wherein the side walls have a boss extending therefrom capable of mating with a tab of the latch assembly to facilitate alignment of the housing assembly with the latch assembly.

7. A door closure assembly suitable for use in maintaining a door in a closed position and permitting the door to be opened and including a latch assembly having a trip lever that acts upon a rotor capable of engaging a striker bolt to maintain the door in the closed position with the rotor in an engaged position, the door closure assembly comprising an inside panel assembly having a panel having an interior surface and an exterior surface, a handle assembly extending from the exterior panel surface and through the panel, and a release arm adjacent to the interior panel surface and operably associated with the handle assembly for rotation of the release arm, the release arm having a window therein that receives the trip lever, wherein rotation of the handle assembly causes the release arm to directly move the trip lever with the rotor in the engaged position therefor.

8. The door closure assembly in accordance with claim 7 wherein the window permits partial rotation of the handle assembly prior to moving the trip lever to permit the handle assembly to be utilized to close the door without maintaining the rotor in the disengaged position.

9. A door closure assembly suitable for use in maintaining a door in a closed position and permitting the door to be opened and including a latch assembly having a trip lever that acts upon a rotor capable of engaging a striker bolt in an engaged position therefor to maintain the door in the closed position, said rotor being movable between the engaged position and a disengaged position, the door closure assembly comprising:

an inside panel assembly having a panel having an interior surface and an exterior surface;

a handle assembly extending from the exterior panel surface and through the panel;

a release arm operably associated with the handle assembly adjacent to the interior panel surface, for rotation of the release arm, the release arm having a widow therein that receives the trip lever, wherein rotation of the handle assembly causes the release arm to directly move the trip lever if the rotor is in the engaged position;

a housing assembly having a housing that terminates at an inner edge that forms the perimeter of a centrally located opening in the housing, connected side walls turned inwardly from the edge and a bottom panel at which the side walls terminate, the side walls and the bottom panel defining a recess, the side walls having a first opening therethrough;

a paddle associated with the housing assembly within the recess, the paddle having a paddle opening extending therethrough, the paddle opening and the first sidewall opening being aligned with the paddle within the recess;

means for pivotably securing the paddle in the housing assembly extending through the paddle opening and the first side wall opening, the securing means pivoting when the paddle is pivoted; and a pivot arm affixed to the securing means, wherein pivoting of the paddle causes the pivot arm to directly move the trip lever if the rotor is in the engaged position.

10. The door closure assembly in accordance with claim 9 wherein the side walls have a second opening therethrough opposed to the first side wall opening and the paddle has an integrally manufactured shank opposed to the paddle opening wherein the shank is received in the second side wall opening.

11. The door closure assembly in accordance with claim 9 wherein a surface adjacent to the first side wall opening and a surface adjacent to the paddle opening are flat and wherein the flat surfaces are adjacent to minimize water transport through the first side wall opening and the paddle opening.

12. The door closure assembly in accordance with claim 9 wherein the side walls have a boss extending therefrom capable of mating with a tab of the latch assembly to facilitate alignment of the housing assembly with the latch assembly.

13. A door closure assembly suitable for use in maintaining a door in a closed position and permitting the door to be opened that acts upon a striker bolt to maintain the door in the closed position, the door closure assembly comprising:

a latch assembly having a rotor capable of engaging the striker bolt to maintain the door in the closed position and a trip lever that acts upon the rotor when the rotor is in the engaged position;

a housing assembly comprising:

a housing that terminates at an inner edge that forms a perimeter of a centrally located opening in the housing, connected side walls turned inwardly from the edge, and a bottom panel at which the side walls terminate, the side walls and bottom walls defining a recess, the side walls having a first opening therethrough;

a paddle associated with the housing assembly within the recess, the paddle having a paddle opening extending therethrough, the paddle opening and the first side wall opening being aligned when the paddle is within the recess;

means for pivotally securing the paddle in the housing assembly extending through the paddle opening and the first side wall opening, the securing means pivoting when the paddle is pivoted; and a pivot arm affixed to the securing means wherein pivoting of the paddle causes the pivot arm to move the trip lever if the rotor is in the engaged position; and an inside panel assembly comprising a panel having an exterior surface and an interior surface, a handle assembly extending from the exterior panel surface and through the panel, and a release arm operably associated with the handle assembly adjacent to the interior panel surface, the release arm having a window therein that receives the trip lever, wherein rotation of the handle assembly causes the release arm to move the trip lever if the rotor is in the engaged position.

14. The door closure assembly in accordance with claim 13 wherein the window permits partial rotation of the handle assembly prior to moving the trip lever to permit the handle assembly to be utilized to close the door without maintaining the rotor in the disengaged position.

15. The door closure assembly in accordance with claim 1 wherein the trip lever directly engages the rotor to rotate the rotor into the disengaged position.

* * * * *